United States Patent [19]

Flint et al.

[11] 4,320,755

[45] Mar. 23, 1982

[54] AIR SUPPLY UNITS

[75] Inventors: Leslie Flint, Leicester; Malcolm P. Brown, Melton Mowbray, both of England

[73] Assignee: Marwin Foundry Units Limited, Leicester, England

[21] Appl. No.: 170,141

[22] Filed: Jul. 18, 1980

[51] Int. Cl.[3] ..... A62B 7/00

[52] U.S. Cl. ..... 128/205.12; 128/204.21; 128/204.18; 55/482; 55/DIG. 35; 55/DIG. 31; 55/359

[58] Field of Search ..... 128/201.25, 204.21, 128/205.12, 205.25, 206.17, 205.27, 205.29, 204.18, 200.27, 200.28, 201.24, 201.29, 1 B, 204.22, 204.23, 205.22, 910, 273, 207.18, 206.27; 2/171.3, 436; 55/DIG. 33, DIG. 35, 467; 505/506, 507, 482, DIG. 31, 381, 359

[56] References Cited

U.S. PATENT DOCUMENTS

| | | | |
|---|---|---|---|
| 3,657,740 | 4/1972 | Cialone | 128/205.25 |
| 4,076,021 | 2/1978 | Thompson | 128/205.18 |
| 4,088,461 | 5/1978 | Brauer | 55/482 |
| 4,200,092 | 4/1980 | Warncke et al. | 55/DIG. 33 |

*Primary Examiner*—Henry J. Recla
*Attorney, Agent, or Firm*—Kalish & Gilster

[57] ABSTRACT

A main casing 34 contains a centrifugal fan 10, a filter unit 12 upstream, and a duct 14 downstream for guiding air to a face mask. There is a center plate 36 to which a motor 18, the fan 10, a battery 20 etc. are secured. A back plate 32 is removable to provide access to the electrical components. The filter unit 12 is held in position by an apertured cap 24.

4 Claims, 4 Drawing Figures

AIR SUPPLY UNITS

DESCRIPTION

The invention relates to an air supply unit suitable for blowing air to a face mask for the respiratory protection of a person working in a noxious or unpleasant industrial atmosphere. Examples of environments in which such a unit is useful include work-places where there is dust or fumes.

Previous proposals include U.K. Patent Specifications Nos. 732248 and 1212821. The former is inconveniently shaped, having a filter 19 projecting to the rear, and a motor 17 in direct communication with a chamber through which induced air is drawn to a blower 18. The latter gives almost no detail of the air supply unit, but is fairly similar as to the arrangement of the components.

According to the invention, the unit comprises a casing, a central plate forming an integral part of the casing, the electrical components being secured to the center plate, a centrifugal fan, and the filter unit being held in position by an apertured cap.

A centrifugal fan has been found necessary to produce sufficient pressure at reasonable power consumption and with a reasonable filter area.

The filter unit upstream of the fan reduces any tendency for the unit to become clogged with dust or other foreign matter. The filter unit may comprise a pre-filter or glass fibre mat, followed by a folded-paper unit to remove dust or an activated carbon unit to absorb organic vapors.

The casing containing all the operative components makes the unit easy to handle and maintain. Preferably, the casing is a plastics moulding and includes a back plate removable to provide access to the motor, battery, and other electrical components such as switches. The casing also preferably includes a center plate to which the motor, fan, battery and other electrical components are releasably secured, for example by screws, so that each can readily be removed for replacement or maintenance. The casing may be provided with loops for a belt for the user, but may be free-standing for example for use on a work bench or in a tractor cab.

The filter unit is preferably across the front of the casing, and the filter itself preferably held in position by an apertured cap, and secured to the casing by screw-threads. A central part of the apertured cap may be removable, leaving a rim for supporting a supplementary filter unit projecting out of the casing through the cap. The fan draws in-coming air through the apertured cap and filter, and impels filtered air to the downstream duct.

The battery is preferably below the motor and duct so as fully to utilize the space available. The battery may be rechargeable through a connection on the side of the casing, and preferably comprises sealed lead/acid or nickel cadmium cells. The motor is preferably of low inductance which is intrinsically safe in an explosive atmosphere. The unit can be made so light that its weight on the belt is not noticable.

DRAWINGS

Figure 2:
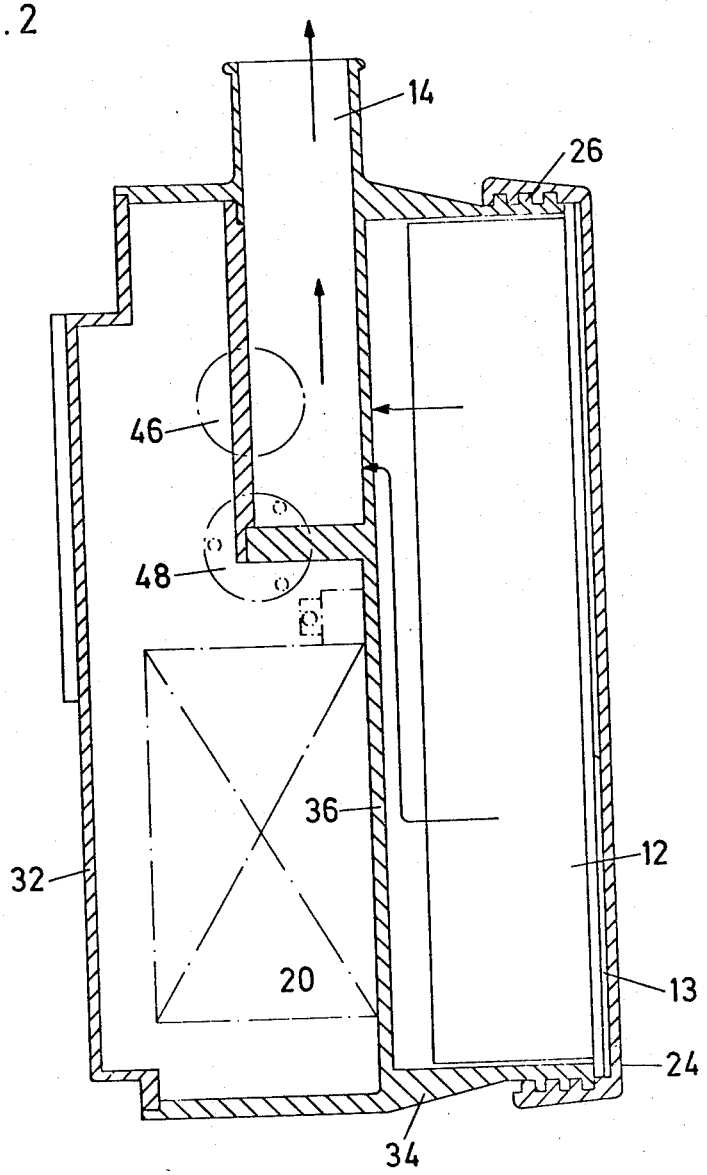
FIG. 2 is a section along A—A of FIG. 1.

In the drawings, a main casing 34 (FIG. 2) contains a centrifugal fan 10, a filter unit 12 upstream, and a duct 14 downstream for guiding blown air to a tube (not shown) incorporating a non-return valve for transmission to a face mask (not shown). The unit is self-contained with an electric motor 18 for driving the fan 10, a rechargeable battery 20 mounted on a central plate 36 (FIG. 2), and belt loops 22 on the outside.

Figure 1:
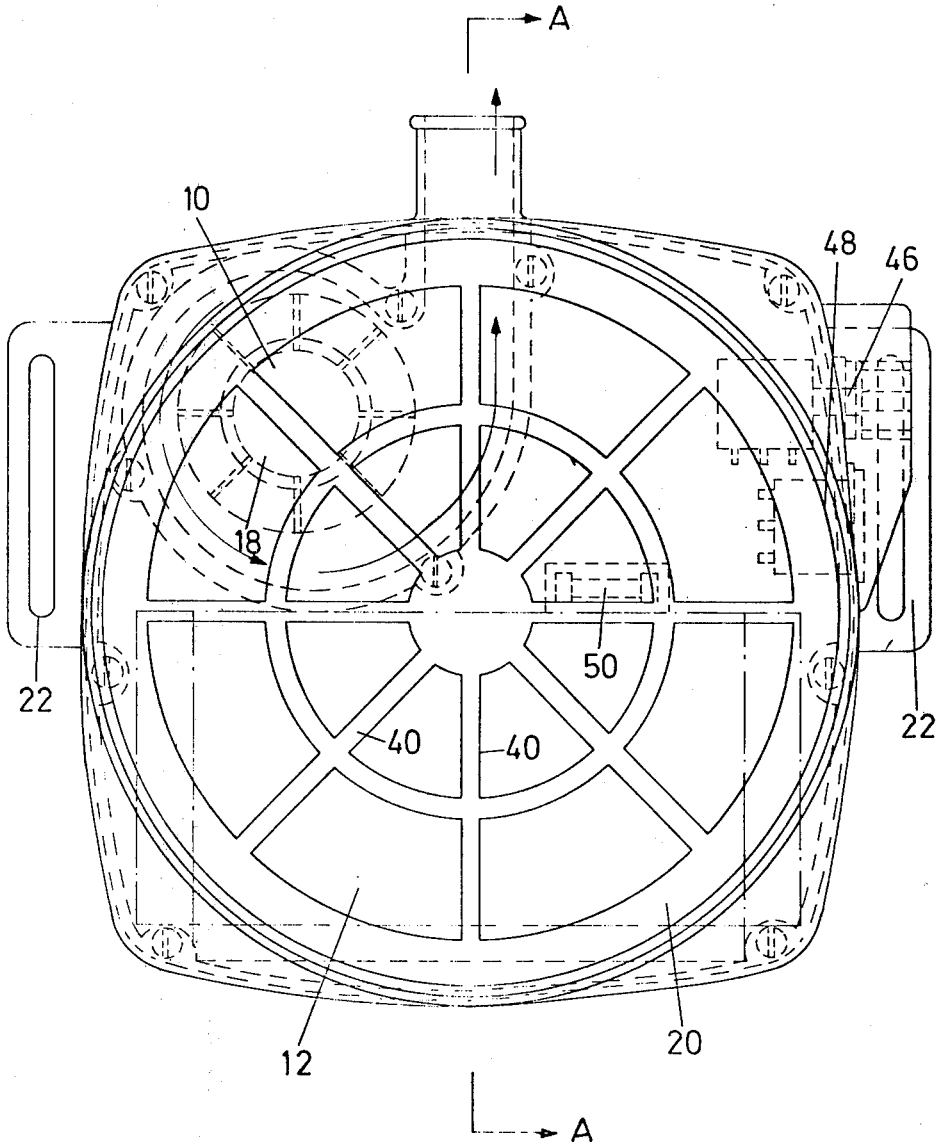
FIG. 1 is a front elevation of a unit according to the invention with components shown in broken lines.
Figure 3:
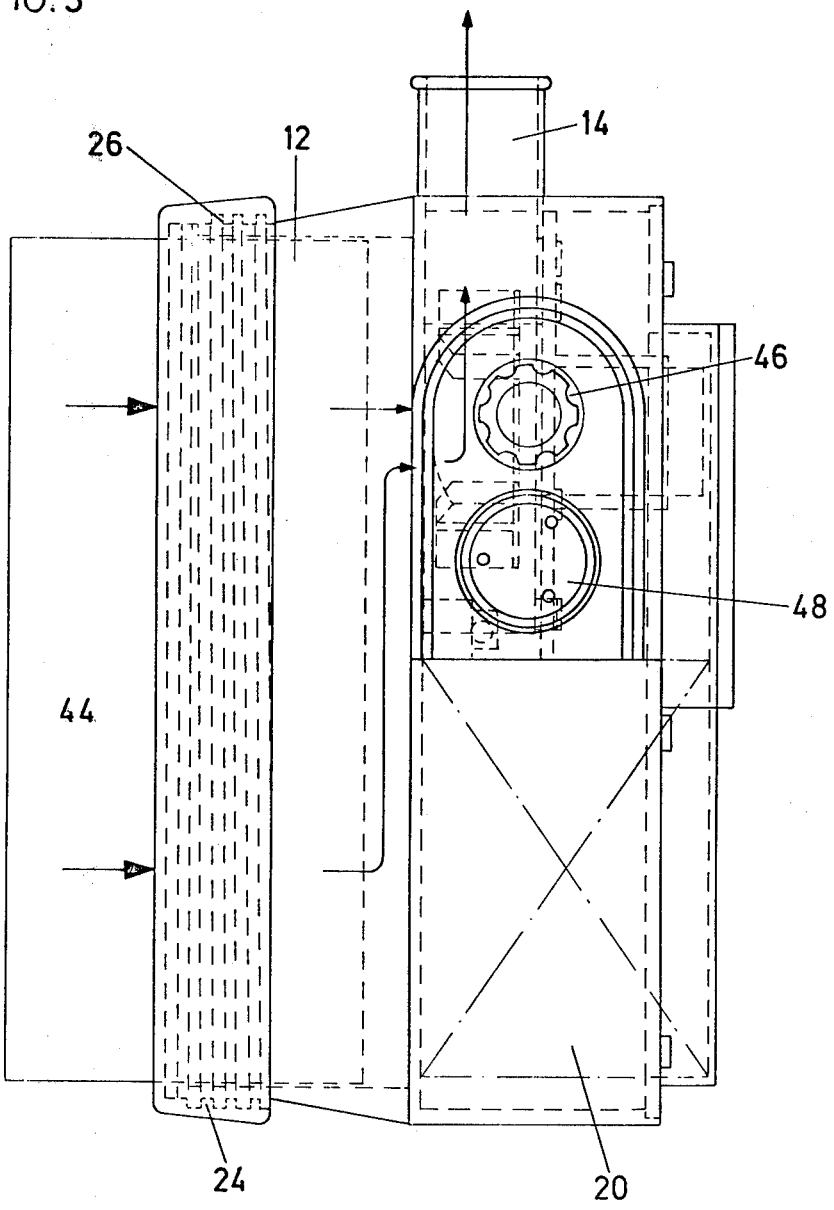
FIG. 3 is a side view corresponding to FIG. 1.
Figure 4:
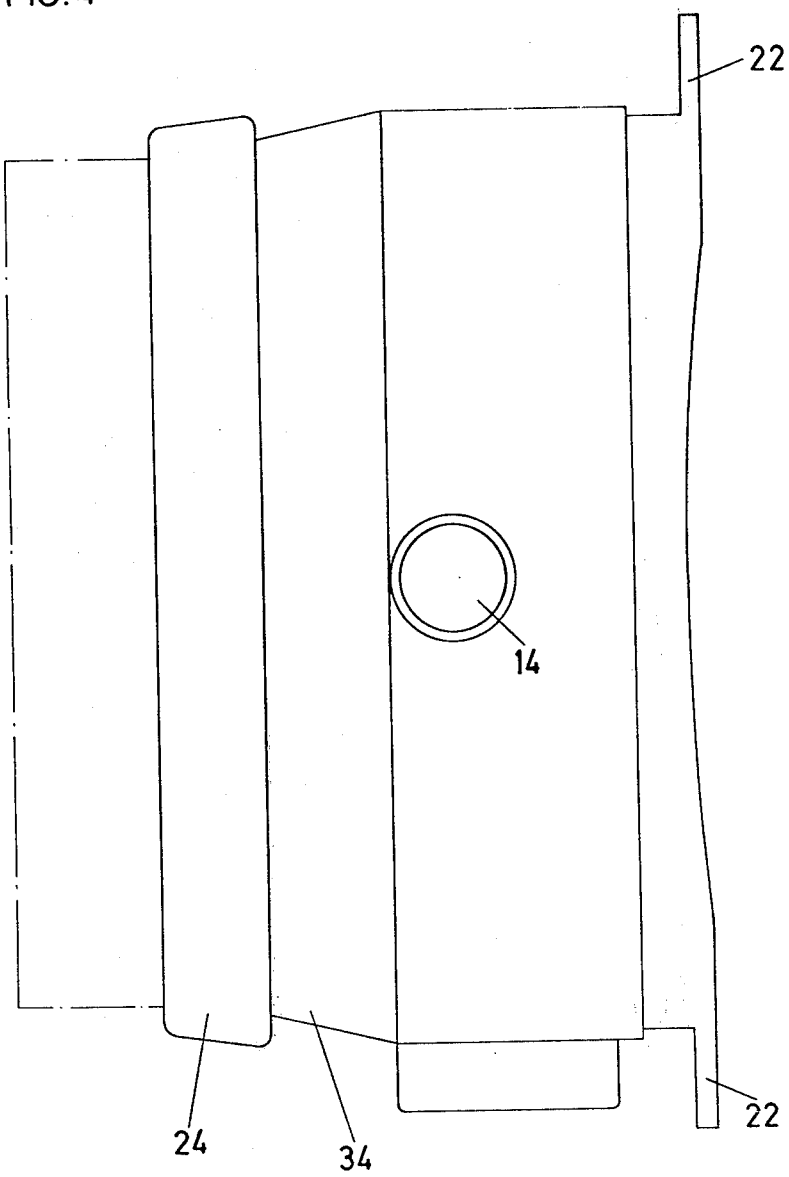
FIG. 4 is an outside plan corresponding to FIG. 1.

An apertured cap 24, with a pre-filter mat 13 trapped therein, secures the filter unit 12 in position and is retained by screw threads 26 covering four segments of the circumference for quick mounting and release. By breaking out the central part of the cap 24, including ribs 40 (FIG. 1), a circumferential rim 42 can be left for securing a second filter unit 44 in front of the unit 12 as in FIG. 3.

A back plate 32 is screwed onto the main casing 34, and can be removed to expose the motor 18 backing onto the fan 10, the battery 20, and a center plate 36, an on-off switch or control knob 46, and a battery recharge socket 48. A safety fuse 50 is provided in the electrical circuit adjacent the motor 18.

We claim:

1. An air supply unit for use with a facemask comprising a casing (34) having a chamber therein, a centre plate in said chamber dividing said chamber into first and second compartments, a passage in said center wall communicating said first and second compartments, a centrifugal fan (10) mounted in said first compartment and having an intake portion communicating with said passage and an output portion, an outlet duct (14) extending from said first compartment and being in flow communication with the output portion of the centrifugal fan (10) said outlet duct including means adapted to be connected to a face mask, an electric motor (18) mounted in said first compartment including means for driving the fan (10), a battery (20) mounted in said first compartment and having electrical means associated therewith for powering the motor (18), said center plate (36) forming an integral part of the casing (34), said motor (18), said fan (10), said battery (20) and said electrical means being secured to the center plate (36), said second compartment having an outer wall opposite said center wall comprised of an aperture cap (24) secured to said casing with screw threads (26), and a filter unit (12) mounted in said second compartment and being in flow communication with said apertured cap and said passage, said filter being held in position by said apertured cap (24), and wherein said apertured cap includes a peripheral rim (20) and a central part (40) removable from said rim whereby a supplemental filter unit (44) can be supported by said rim.

2. An air supply unit according to claim 1 wherein said casing (34) includes a back plate (32) spaced from, and planarwise parallel to, said centre plate (36), said apertured cap (24) being detachably mounted on said casing (34) spacedly from, and planarwise parallel to, said centre plate (36) and being located proximate the side of said centre plate (36) remote from said back plate (32).

3. An air supply unit according to claim 2 wherein said back plate (32) is detachably mounted on said casing (34), said motor (18), fan (10) and battery (20) being secured to the side of said centre plate (36) proximate said back plate (32) whereby said components are readily accessible upon removal of said back plate (32).

4. An air supply unit according to claim 3 wherein said filter unit (12) is disposed between said centre plate (36) and said aperture cap (24) and with said duct (14) being located on the side of said centre plate (36) remote from said filter (12).

* * * * *